US010134523B2

(12) United States Patent
Kawashima et al.

(10) Patent No.: US 10,134,523 B2
(45) Date of Patent: Nov. 20, 2018

(54) COIL COMPONENT

(71) Applicant: SUMIDA CORPORATION, Tokyo (JP)

(72) Inventors: Hiroshi Kawashima, Nagano (JP); Takayuki Yamaguchi, Nagano (JP)

(73) Assignee: SUMIDA CORPORATION, Tokyo (JP)

( * ) Notice: Subject to any disclaimer, the term of this patent is extended or adjusted under 35 U.S.C. 154(b) by 0 days.

(21) Appl. No.: 15/286,974

(22) Filed: Oct. 6, 2016

(65) Prior Publication Data

US 2017/0110243 A1 Apr. 20, 2017

(30) Foreign Application Priority Data

Oct. 19, 2015 (JP) ..... 2015-205249

(51) Int. Cl.

| | |
|---|---|
| ***H01F 27/24*** | (2006.01) |
| ***H01F 17/06*** | (2006.01) |
| ***H01F 21/06*** | (2006.01) |
| ***H01F 29/10*** | (2006.01) |
| ***H01F 29/14*** | (2006.01) |
| ***H01F 13/00*** | (2006.01) |
| ***H01F 27/26*** | (2006.01) |

(52) U.S. Cl.

CPC ..... *H01F 29/10* (2013.01); *H01F 13/00* (2013.01); *H01F 27/26* (2013.01); *H01F 29/146* (2013.01); *H01F 2029/143* (2013.01)

(58) Field of Classification Search

USPC ..... 336/131, 132, 134

See application file for complete search history.

(56) References Cited

U.S. PATENT DOCUMENTS

| | | | | |
|---|---|---|---|---|
| 5,315,279 | A * | 5/1994 | Ito | H01F 3/14 336/178 |
| 9,251,946 | B2 * | 2/2016 | Sato | H01F 1/24 |
| 2013/0241686 | A1 | 9/2013 | Nakatsu et al. | |

FOREIGN PATENT DOCUMENTS

| | | | |
|---|---|---|---|
| DE | 733 783 | C | 4/1943 |
| DE | 922 423 | C | 1/1955 |
| JP | S63-201314 | U | 12/1988 |

OTHER PUBLICATIONS

Apr. 7, 2017 Search Report issued in European Patent Application No. 16193467.4.

* cited by examiner

*Primary Examiner* — Ronald Hinson
(74) *Attorney, Agent, or Firm* — Oliff PLC

(57) ABSTRACT

A coil component has a core part 10 composing a closed magnetic path through which a closed loop of a magnetic flux passes, the magnetic flux being generated by two coils 14A, 14B that are arranged in parallel, and generate a magnetic field, and the core part 10 has a pair of I-type base cores 11A, 11B facing each other, and a pair of coupling core parts 11C, 11D. The coupling core parts 11C, 11D are each formed by linearly aligning three unit coupling cores 12A to 12F, and each of these cores 12A to 12F is formed into a configuration in which a column-shaped projection is provided on a core body, and a two-stage gap including a small gap and a large gap is to be formed mutually in a space in the adjacent unit cores 11A, 11B, and 12A to 12F by the configuration.

11 Claims, 9 Drawing Sheets

COIL COMPONENT

RELATED APPLICATIONS

This application claims the priority of Japanese Patent Application No. 2015-205249 filed on Oct. 19, 2015, which is incorporated herein by reference.

BACKGROUND OF THE INVENTION

Field of the Invention

The present invention relates to a coil component formed of a reactor to be mounted on an electric vehicle or a hybrid vehicle, and more specifically to a coil component in which a suitable gap is provided on a magnetic path in a closed magnetic path.

Description of the Prior Art

A coil component of this type has so far been configured by winding a winding wire around a magnetic core in a closed magnetic path. In general, in order to prevent reduction of an inductance value of the winding wire during DC superposition, measures have been applied for reducing an influence of magnetic saturation by providing a suitable gap (void) part on a magnetic path of the magnetic core.

For example, an art described in Patent Document 1 below relates to a ferrite core for a choke coil for smoothing, in which the ferrite core is configured in such a manner that a pair of E-type ferrite cores are combined so as to be butted in leading ends of three leg parts to abut with each other, and a gap is provided only in a central part of a butting part of a middle leg.

According to the above art, a shape of a curve of the DC superposed characteristics can be adjusted to some extent by adjusting a proportion of an area of a void part of the middle leg to a total cross section and a length of a void of the E-type ferrite core in a facing direction on a butting surface of the pair of E-type ferrite cores.

RELATED PRIOR ART

Patent Document 1: Japanese Laid-Open Utility Model Publication No. S63-201314

However, in an art in the document, as shown in FIG. 7, even when a demand is expressed for desirably obtaining target characteristics (obtained by connecting square-shaped points in FIG. 7) in such a manner that an initial inductance value is increased, and simultaneously an inductance value at a predetermined current value is increased to a predetermined value (the inductance value is adjusted to 26 μH when a current is 50 A in FIG. 7), adjustment so as to satisfy both cannot be made, resulting in DC superposed characteristics (obtained by connecting diamond-shaped points in FIG. 7) in which the initial inductance value and also the inductance value when the current is 50 A become significantly lower than target values.

SUMMARY OF THE INVENTION

The present invention has been made in view of such circumstances, and is contemplated for providing a coil component that can be simply set to a desired inductance value in a plurality of DC value regions in DC superposed characteristics.

In order to solve the problem, the coil component according to the present invention relates to a coil component having a coil and a core part composing a closed magnetic path through which a closed loop of a magnetic flux generated by the coil passes, wherein:

the core part is composed of a plurality of unit cores, the plurality of unit cores are magnetically and sequentially coupled, and the closed magnetic path is formed as a whole, and a gap is formed by being provided between at least one set of the magnetically coupled and adjacent unit cores; and a projection is provided on an end surface of at least one of the adjacent two unit cores with interposing the gap therebetween, and the gap is formed of at least two types of gaps including a small gap and a large gap.

An expression "at least two types of gaps including a small gap and a large gap" described above means having two or more types of gaps, including a case where the gap has three types of gaps including a large gap, a middle gap, and a small gap, for example.

The small gap is preferably formed by a leading end surface region of the projection, and an end surface facing the region of the adjacent unit core, and the large gap is preferably formed by an end surface region facing the region in which no projection is provided and an end surface of the adjacent unit core.

Further, the core part can be formed by forming a square-shaped closed magnetic path with two channel-shaped unit cores facing each other.

Further, the core part can be composed of two I-type base core parts respectively composing two sides facing each other, and two coupling core parts that couple the base cores and respectively compose two sides facing each other.

Further, the coupling core parts can be each arranged within the coil through which a current passes, and the plurality of coupling core parts can be each formed by arranging the plurality of unit cores in a row.

The core part may be arranged in such a manner that the projections are provided on both end surfaces facing each other relative to the adjacent two unit cores with interposing the gap therebetween, and the projections respectively formed on the end surfaces facing each other become coaxial in a state in which the core part composes the closed magnetic path.

The projection may be provided on one of the end surfaces facing each other relative to the adjacent two unit cores with interposing the gap therebetween, and the other may be formed into a flat surface.

The inductance values in the at least two DC value regions of the curve of the DC superposed characteristics can be controlled independently by the at least two types of gaps, and one of the at least two DC value regions serves as a region in which a DC current value becomes 0.

At least one of the two DC value regions can be formed into a region in which a DC current value becomes 0.

Further, the region can be formed into a region in which a spacer formed of an insulator can be fitted into the gap.

Further, the unit core composing the coupling core part can be formed by providing, on a rectangular parallelepiped-shaped or column-shaped unit core body, a projection having a top surface analogous to a top surface of the unit core body.

Further, the unit core composing the coupling core part can be formed by providing, on a rectangular parallelepiped-shaped or column-shaped unit core body, one stripe or two stripes of projections linearly extending between positions facing each other relative to a top surface of the body.

Further, the unit core composing the coupling core part can be formed by providing, on a rectangular parallelepiped-shaped or column-shaped unit core body, a two-stage projection.

According to the coil component of the present invention, the coil component is configured in such a manner that the core part composing the closed magnetic path through which the closed loop of the magnetic flux generated by the coil passes are formed of the plurality of unit cores, the plurality of unit cores are magnetically and sequentially coupled, and the closed magnetic path is formed as a whole, and a space between at least one set of the magnetically coupled adjacent unit cores is formed into an entire gap wholly formed into a non-abutting state to each other, and the entire gap is formed of at least two types of gaps including the small gap and the large gap. Then, in order to provide the two or more types of gaps, the projection is provided on at least one of end surfaces facing each other relative to the adjacent unit cores.

That is, the space between the adjacent unit cores is formed into the entire gap, and therefore magnetic saturation becomes hard to occur in the gap part, and simultaneously at least the two types of gaps including the small gap and the large gap are provided, and therefore at least a length of the two types of gaps can be easily adjusted in such a manner that a desired inductance value is each obtained in at least two DC value regions with regard to DC superposed characteristics of the coil component.

Accordingly, inductance values in a plurality of target points in the DC superposed characteristics can be simply set.

DESCRIPTION OF THE PREFERRED EMBODIMENTS

Figure 1:
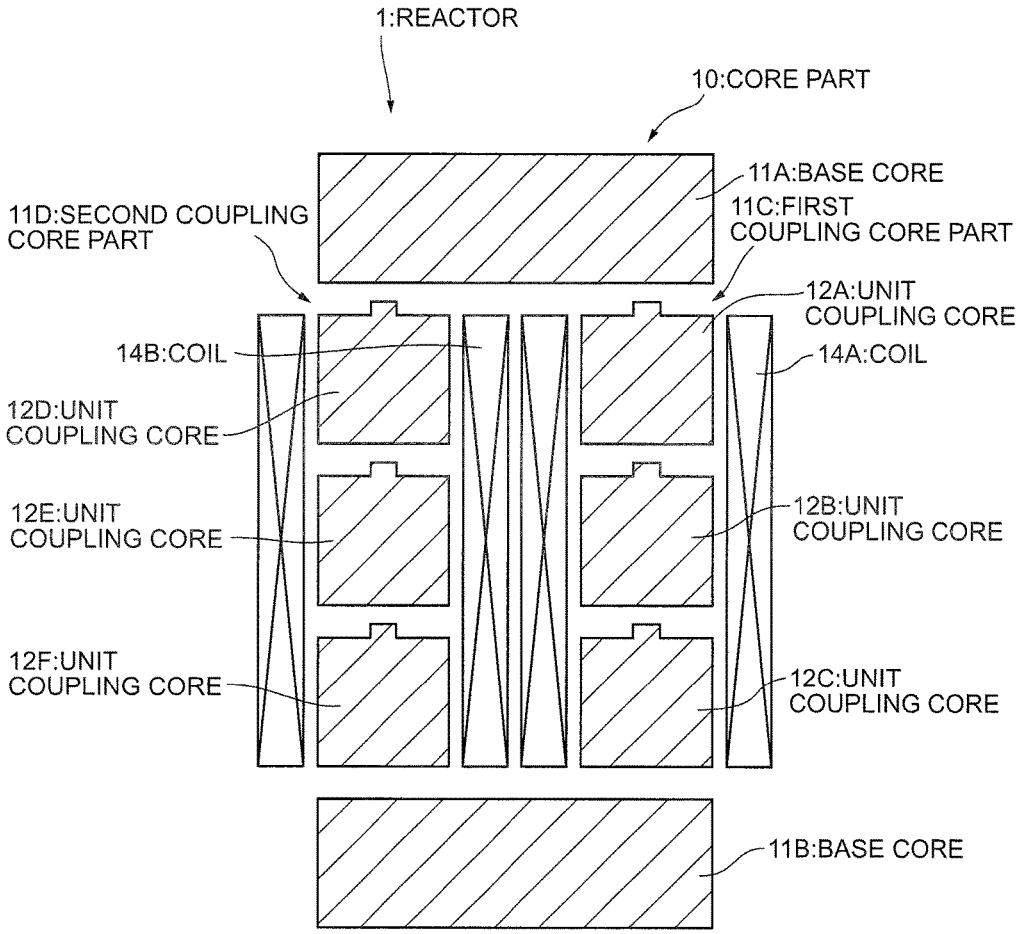
FIG. 1 is a cross-sectional view showing a schematic configuration of a coil component according to an embodiment of the present invention.
Figure 1A:
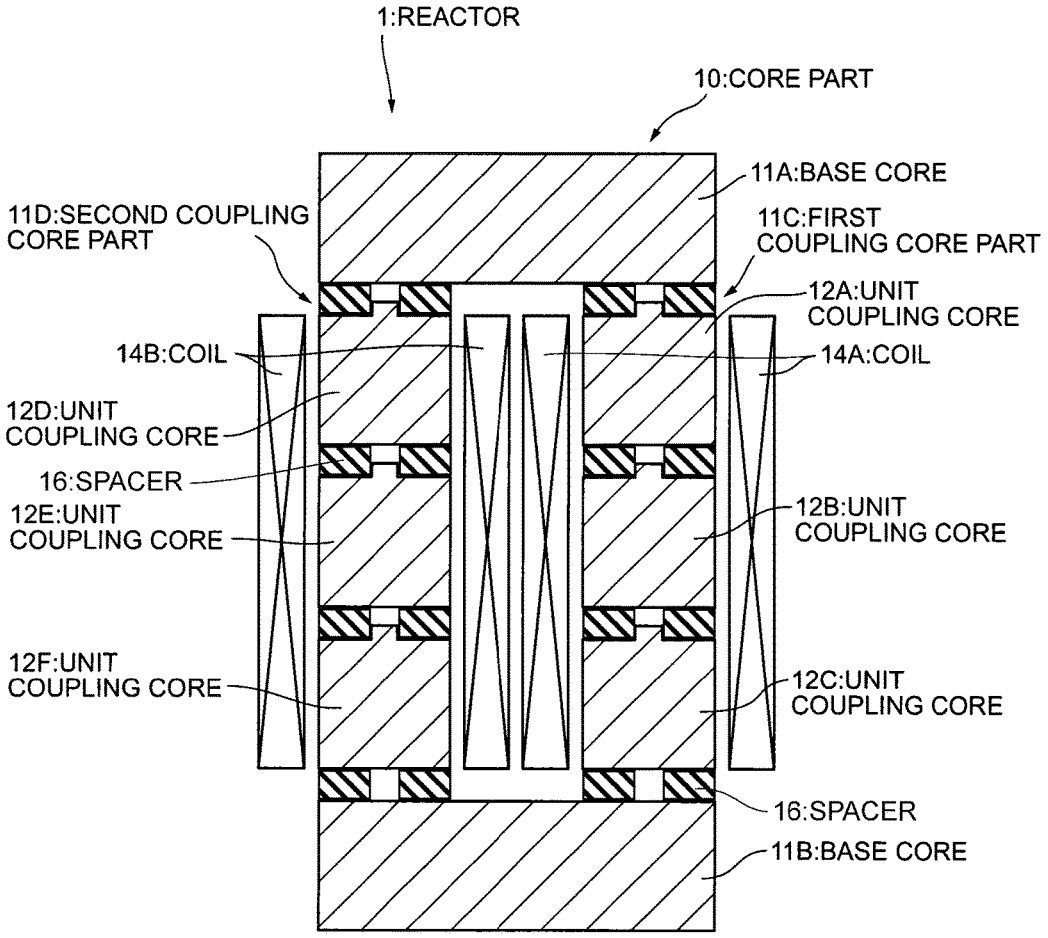
FIG. 1A is a cross-sectional view showing a schematic configuration of the coil component of FIG. 1 according to an embodiment of the present invention.

An embodiments of a coil component according to the present invention will be described below in detail with reference to the drawing. In addition, in the coil component of the present embodiment, a reactor as a representative example is used.

<Main Configuration of Reactor>

A reactor 1 according to one embodiment of the present invention, as shown in FIG. 1, is composed of two coils 14A and 14B which are arranged in parallel to each other to generate a magnetic field, and a core part 10 which forms a closed magnetic path through which a closed loop of a magnetic flux generated by the two coils 14A and 14B passes. The core part 10 further formed by having a pair of I-type base cores 11A and 11B which are arranged so as to face each other and inserted into each of the coils 14A and 14B, respectively, and a pair of coupling core parts 11C (first coupling core part) and 11D (second coupling core part) arranged in parallel therebetween so as to couple the two base cores 11A and 11B.

The coils 14A and 14B each are an edgewise coil formed by having a pair of winding parts (division (boundary line) between conducting wires for each (not shown)) formed by a rectangular conducting wire (rectangular wire) being edgewise wound in a monolayer into a cylinder, a lead wire part (not shown) provided on one end side of each winding part, and a coupling wire part (not shown) for electrically coupling the winding parts to each other, for example.

The two base cores 11A and 11B are formed into rectangular parallelepiped shapes identical with each other. On the other hand, a first coupling core part 11C of the coupling core parts 11C and 11D is formed by linearly aligning three unit coupling cores 12A, 12B, and 12C, and a second coupling core part 11D is formed by linearly aligning three unit coupling cores 12D, 12E, and 12F.

In addition, specific examples of a material composing the core part 10 include a magnetic material such as a silicon steel plate and various powder cores.

Figure 2:
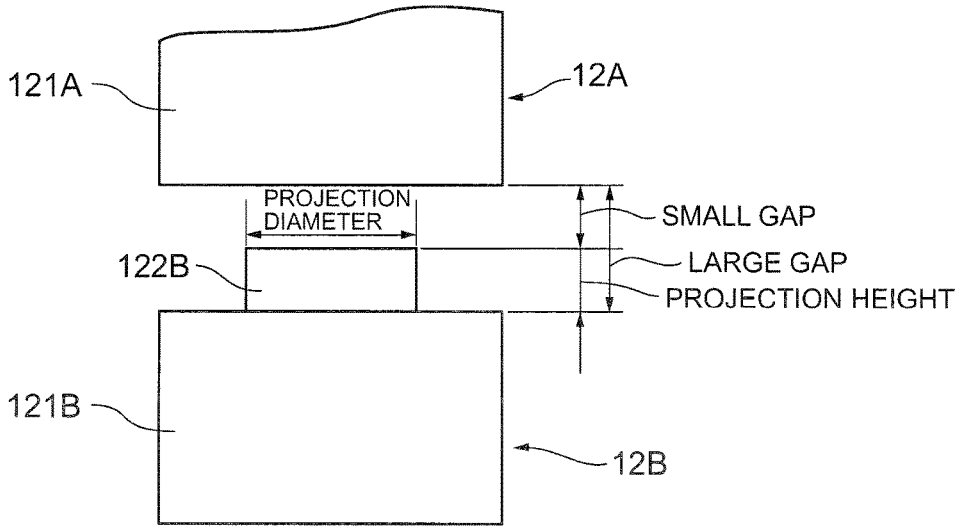
FIG. 2 is a schematic view for describing an aspect of gaps between adjacent coupling part unit corers of the coil component according to the embodiment of the present invention.

As shown in FIG. 2 (a positional relationship between the adjacent unit coupling cores 12A and 12B is shown as a representative example in FIG. 2), in the coupling cores parts 11C and 11D, the adjacent unit coupling cores 12A and 12B are arranged so as to interpose a gap without being abutted to each other on a whole surface between end surfaces facing each other.

That is, as shown in FIG. 2, the unit coupling core 12B is formed of a unit core body 121B and a projection 122B (the same applies to other unit coupling cores 12A and 12C to 12F). In addition, in the following, a distance from a top surface (leading end surface) of the projection 122B to a bottom surface of the unit coupling core 12A is referred to as a small gap, and a distance obtained by adding a height of the projection 122B (projection height) to the small gap is referred to as a large gap (distance from a top surface of the unit core body 121B to a bottom surface of the unit core body 121A) (the same also applies to other unit coupling cores 12A and 12C to 12F).

Figures 3A, 3B, 3C, 3D, 3E:
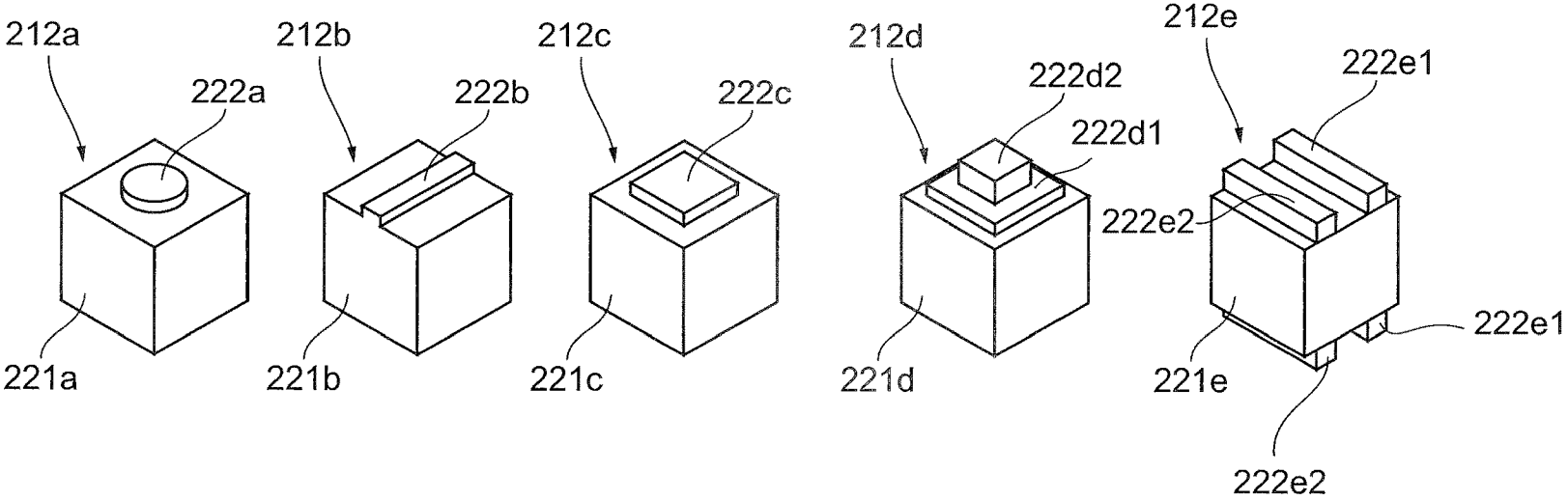
FIG. 3A is a perspective view showing a shape (on a rectangular parallelepiped-shaped unit core body 221*a*, a column-shaped projection 222*a* is provided) of coupling part unit cores of the coil component according to the embodiment of the present invention.
FIG. 3B is a perspective view showing a shape (on a rectangular parallelepiped-shaped unit core body 221*b*, one stripe of projection 222*b* linearly extending between two sides facing each other on the top surface of the body is provided) of coupling part unit cores of the coil component according to the embodiment of the present invention.
FIG. 3C is a perspective view showing a shape (on a rectangular parallelepiped-shaped unit care body 221*c*, a rectangular parallelepiped-shaped projection 222*c* having a (analogously shaped) top surface in which the shape of the top surface of the unit core body 221*c* is made smaller by one size is provided) of coupling part unit cores of the coil component according to the embodiment of the present invention.
FIG. 3D is a perspective view showing a shape (on a top surface of a unit coupling core 221*d*, a two-stage projection (222*d*1, 222*d*2) to form a three-stage step including the top surface of the unit core body 221*d*, thereby forming the three-stage gap (a large gap, a middle gap, and a small gap) is provided) of coupling part unit cores of the coil component according to the embodiment of the present invention.
FIG. 3E is a perspective view showing a shape (on a top surface and a bottom surface of a unit core body 221*e*, two stripes of projections 222*e*1 and 222*e*2 extending in parallel between two sides facing each other on the top surface and the bottom surface of the body 221*e* is provided) of coupling part unit cores of the coil component according to the embodiment of the present invention.

In addition, as a specific shape of the coupling cores 12A to 12F in the present embodiment, as shown as a unit coupling core 212*a* in FIG. 3A, a column-shaped projection 222*a* is provided on a rectangular parallelepiped-shaped unit core body 221*a*.

Therefore, a two-stage gap including the small gap and the large gap is to be formed between the adjacent unit coupling cores 12A and 12B.

Thus, a curve shape of the DC superposed characteristics can be controlled by adjusting magnitude of the small gap and magnitude of the large gap, and an area of the small gap and an area of the large gap (area of the gap as a whole−area of the small gap=area of the large gap).

Such an adjustment technique will be described below.

Figure 7:
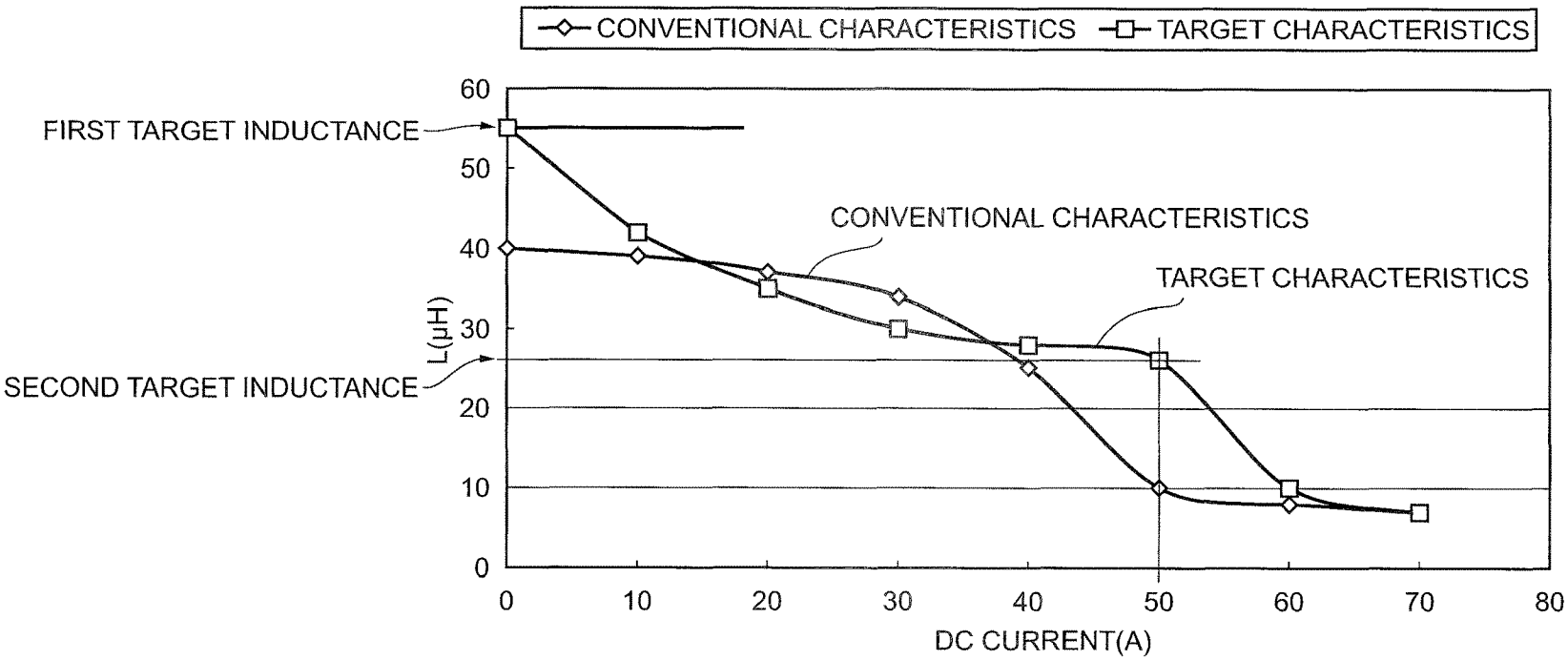
FIG. 7 is a graph showing a curve shape of DC superposed characteristics in a conventional technology and a curve shape of DC superposed characteristics desired to be realized.

In the present embodiment, a desired curve of the DC superposed characteristics as shown in FIG. 7 is ensured by providing the small gap and the large gap, that is, first target inductance in a region in which a DC current becomes 0 and second target inductance in a high DC current value to some extent (50 A in the present embodiment) are ensured.

A factor by which the first target inductance and the second target inductance can be made larger in comparison with a curve of the DC superposed characteristics according to the conventional technology results from non-existence of an abutting part and further provision of the two-stage gap (gaps in six portions are formed into the two-stage gap as shown in FIG. 1) between the adjacent unit cores among the base cores (each base core is also referred to as a unit core) and the unit coupling cores 12A to 12F (each unit coupling core is also referred to as a unit core).

In other words, an inductance value of the region in which the DC current is approximately 0 can be set mainly by the small gap, between the two types of gaps, and the inductance value in a middle region of the curve of the DC superposed characteristics can be set mainly by the large gap. Therefore, the inductance values in the two DC regions can be controlled by one two-stage gap independently to some extent.

In addition, to take a specific numerical number as one example in FIG. 2, for example, as shown in Table 1 below, when the magnitude of the large gap is adjusted to be constant at 2.5 mm regardless of samples, if a projection height is adjusted to 1.0 mm in a sample 1, 1.5 mm in a sample 2, and 2.0 mm in a sample 3, the magnitude of the small gap results in 1.5 mm in the sample 1, 1.0 mm in the sample 2, and 0.5 mm in the sample 3, respectively.

If top surfaces of the unit coupling cores 12A to 12F are formed into a square having one side of 30 mm and a projection diameter is adjusted to 10 mm in the sample 1, 15 mm in the sample 2, and 20 mm in the sample 3, an area ratio of the small gap to the gap as a whole results in $25\pi 900 \approx 8.7\%$ in the sample 1, $56.25\pi/900 \approx 19.6\%$ in the sample 2, and $100\pi/900 \approx 34.9\%$ in the sample 3.

Further, an area ratio of the small gap to the large gap results in 9.6% in the sample 1, 24.4% in the sample 2, and 53.6% in the sample 3.

Thus, a non-linear shape of the curve of the DC superposed characteristics is easily adjusted by controlling the area and the magnitude of gap for each of the small gap and the large gap between the adjacent unit coupling cores 12A to 12F, and between the base core 11A and the adjacent unit coupling cores 12A and 12D. In particular, the two target inductance values described using FIG. 7 can be each independently set.

In addition, the magnitude of the large gap and the small gap mentioned above can be easily maintained at predetermined magnitude of the gap by interposing a spacer 16 formed of an insulator between the adjacent two unit cores 11A and 11B, and 12A to 12F (the same also applies to the spacers 116 of the modified embodiment FIGS. 6 and 6A described below).

In the embodiment, a core having the shape shown in FIG. 3A is used as the shapes of the unit coupling cores 12A to 12F, but in place thereof, as in a unit coupling core 212*b* shown in FIG. 3B, a core may be formed into a shape obtained by providing, on a rectangular parallelepiped-shaped unit core body 221*b*, one stripe of projection 222*b* linearly extending between two sides facing each other on the top surface of the body, or as in a unit coupling core 212*c* shown in FIG. 3C, a core may be formed into a shape obtained by providing, on a rectangular parallelepiped-shaped unit core body 221*c*, a rectangular parallelepiped-shaped projection 222*c* having a (analogously shaped) top surface in which the shape of the top surface of the unit core body 221*c* is made smaller by one size.

Further, as in a unit coupling core 212*d* shown in FIG. 3D, a core may be formed into a shape obtained by providing, on a top surface of a unit coupling core 221*d*, a two-stage projection (222*d*1, 222*d*2) to form a three-stage step including the top surface of the unit core body 221*d*, thereby forming the three-stage gap (a large gap, a middle gap, and a small gap).

Further, as in a unit coupling core 212*e* shown in FIG. 3E, a core may be formed into a shape obtained by providing, on a top surface and a bottom surface of a unit core body 221*e*, two stripes of projections 222*e*1 and 222*e*2 extending in parallel between two sides facing each other on the top surface and the bottom surface of the body 221*e*. In the above case, the projections formed on the top surface and the bottom surface are formed to be vertically overlapped to each other.

Further, as the shapes of the unit core bodies 221*a* to 221*e*, a core can be formed into a shape other than a rectangular parallelepiped shape, for example, a column shape.

EXAMPLES

In an embodiment shown in FIG. 1, for cases (1) and (2) below, investigation was made on how DC superposed characteristics were changed by varying magnitude of projection (magnitude of gap) of unit coupling cores 12A to 12F, and an area (projection diameter: gap area) of a top surface of the projection. In addition, as shapes of the unit coupling core 12A to 12F, samples having the same type in FIG. 3A and the same size were used for all, and an interval each between adjacent unit cores (magnitude of a large gap) was kept constant at 2.5 mm (see Table 1 below for three samples).

TABLE 1

| Sample | Unit | | | |
|---|---|---|---|---|
| | Projection diameter (mm) | Projection height (mm) | Small gap (mm) | Large gap (mm) |
| 1 | 10 | 1.0 | 1.5 | 2.5 |
| 2 | 15 | 1.5 | 1.0 | 2.5 |
| 3 | 20 | 2.0 | 0.5 | 2.5 |

Figure 4:
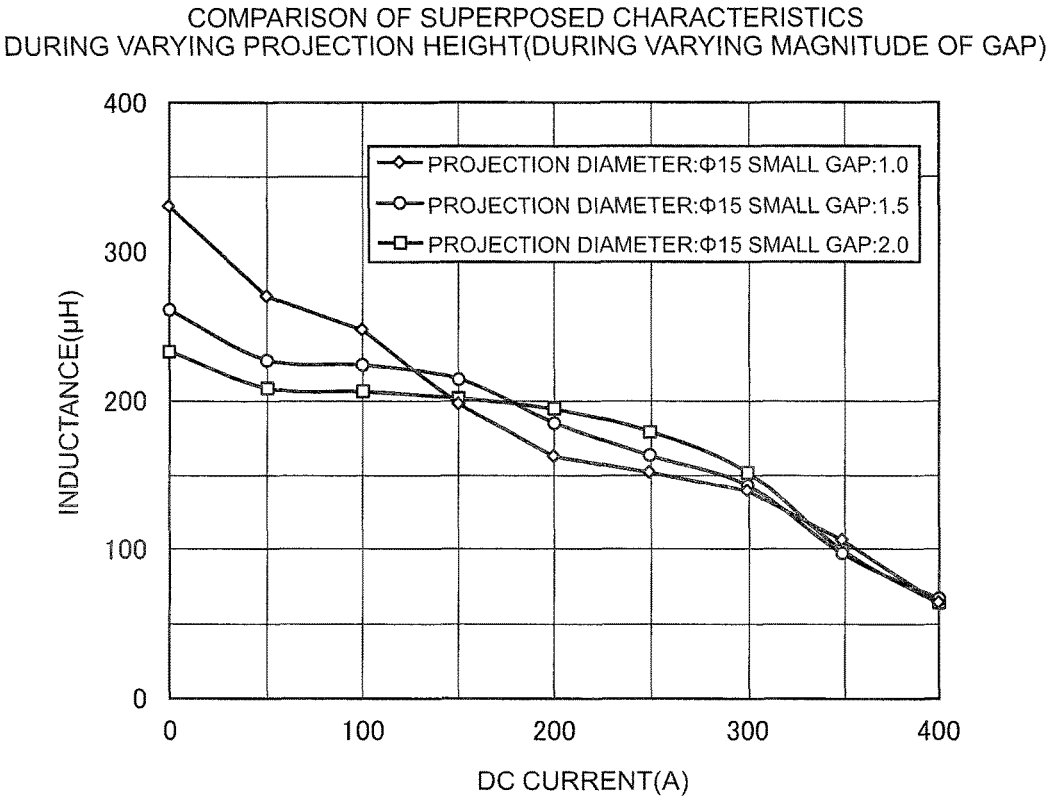
FIG. 4 is a graph showing a change in curve shapes when magnitude of a gap between coupling part unit cores is varied in DC superposed characteristics of the coil component according to the embodiment of the present invention.

(1) Case where a Projection Diameter was Kept Constant at 15 mm, and Magnitude of a Small Gap was Changed to 1.0 mm, 1.5 mm, and 2.0 mm As shown in FIG. 4, DC superposed characteristics when magnitude of a small gap was adjusted to 1.0 mm were shown by a line obtained by connecting diamond-shaped marks, DC superposed characteristics when the magnitude of the small gap was adjusted to 1.5 mm were shown by a line obtained by connecting round marks, and DC superposed characteristics when the magnitude of the small gap was adjusted to 2.0 mm were shown by a line obtained by connecting square marks.

As is obvious from FIG. 4, while an initial inductance value becomes larger as the magnitude of the small gap is smaller, and for example, the inductance value when a DC current is 250 A becomes larger as the magnitude of the small gap is larger.

Figure 5:
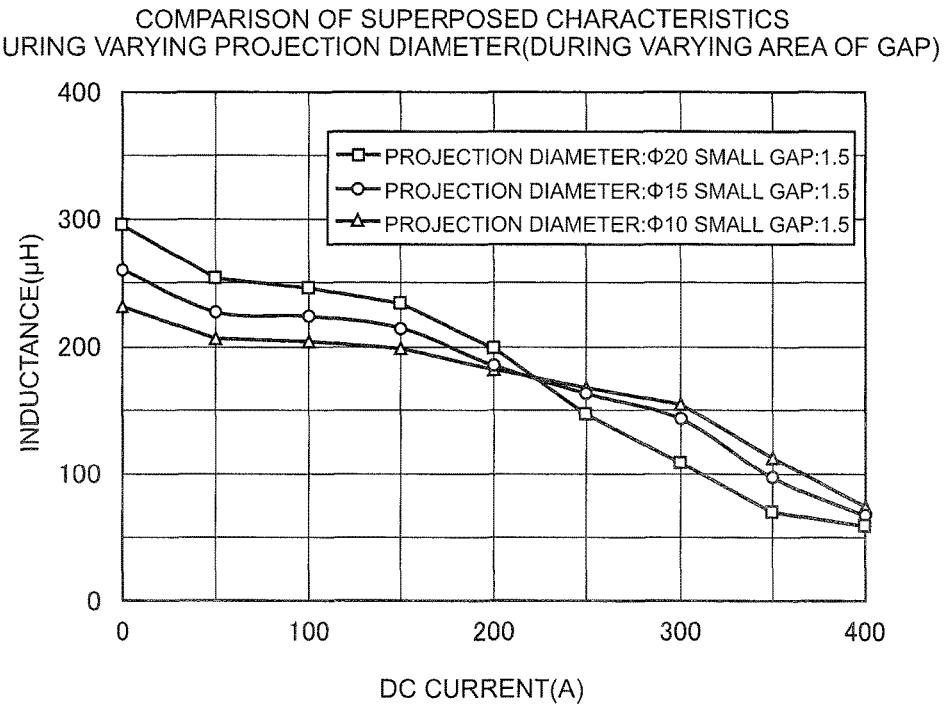
FIG. 5 is a graph showing a change in curve shapes when a projection diameter of a coupling part unit core is varied in DC superposed characteristics of the coil component according to the embodiment of the present invention.

(2) Case where a Small Gap was Kept Constant at 1.5 mm, and a Projection Diameter was Changed to 20 mm, 15 mm, and 10 mm As shown in FIG. 5, DC superposed characteristics when a projection diameter was adjusted to 20 mm were shown by a line obtained by connecting square marks, DC superposed characteristics when the projection diameter was adjusted to 15 mm were shown by a line obtained by connecting round marks, and further DC superposed characteristics when the projection diameter was adjusted to 10 mm were shown by a line obtained by connecting triangular marks.

As is obvious from FIG. 5, while an initial inductance value becomes larger as the projection diameter is larger, and for example, the inductance value when a DC current is 300 A becomes larger as the projection diameter is smaller.

Thus, various non-linear DC superposed characteristics can be obtained by combining and adjusting the magnitude of the small gap (the magnitude of the small gap and the magnitude of the large gap if an interval between the unit cores is constant) and the area of the small gap (the area of the small gap and the area of the large gap if areas of surfaces facing each other relative to the unit cores are constant).

For example, the initial inductance value can be set to a large value by setting the magnitude of the small gap to a small value, and the inductance value when the DC current is 250 A can be set to a large value by setting the magnitude of the large gap to a large value.

Modified Embodiment

A coil component of the present invention is not limited to the component in the embodiment, and other components in various embodiments can be selected.

Figure 6:
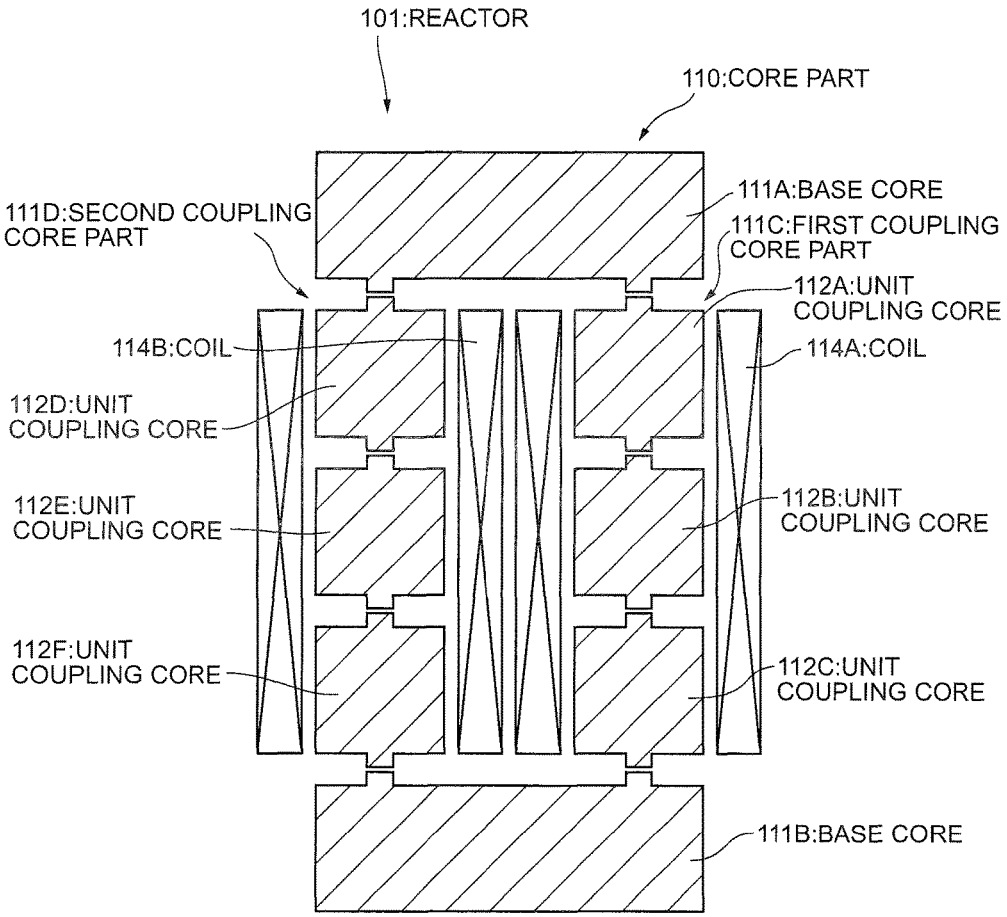
FIG. 6 is a cross-sectional view showing a schematic configuration of a coil component according to a modified embodiment of the present invention.
Figure 6A:
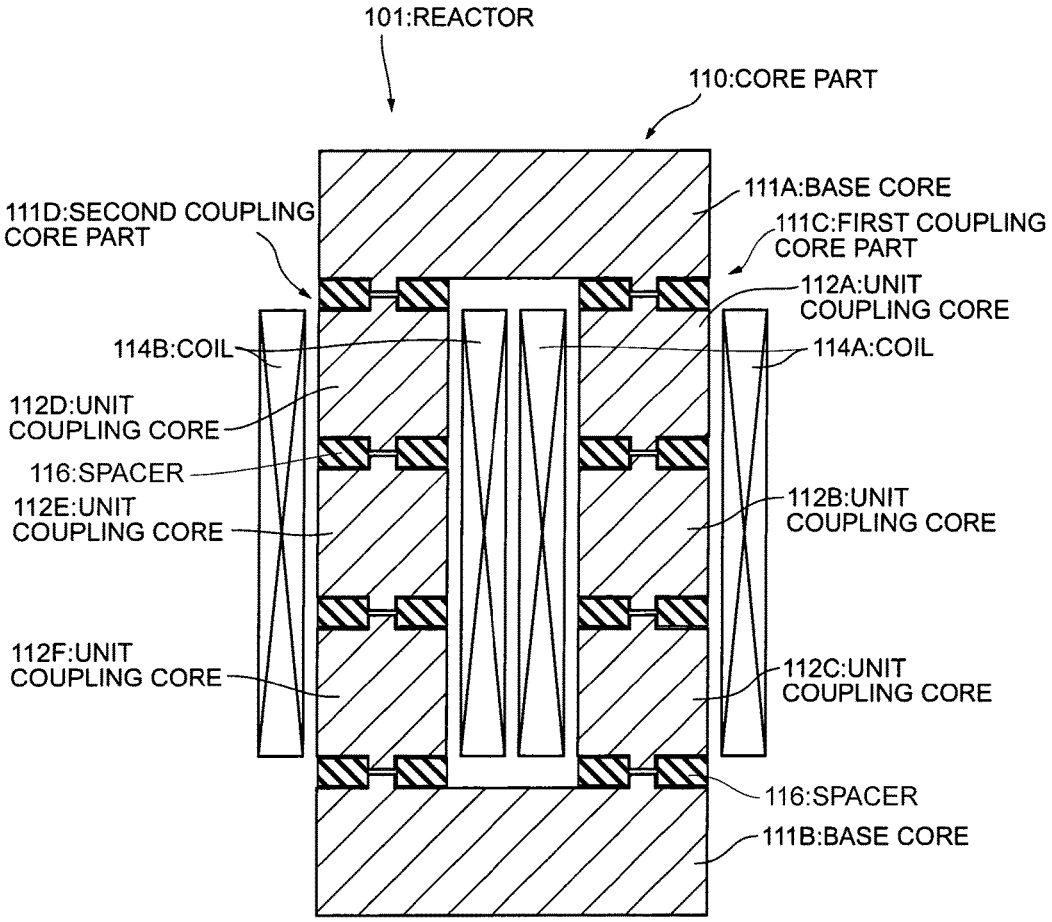
FIG. 6A is a cross-sectional view showing a schematic configuration of the coil component of FIG. 6 according to a modified embodiment of the present invention.

For example, FIG. 6 is a schematic cross-sectional view showing a reactor 110 according to a modified embodiment of the embodiment.

The reactor 110 shown in FIG. 6 is different in that the coil component is configured so as to form a small gap by facing projections each other in each of adjacent unit cores 111A, 111B, and 112A to 112F, and other configurations are substantially similar thereto. Therefore, for a member corresponding to each of members shown in FIG. 1, each member in FIG. 6 is designated with a numeral obtained by adding 100 to the numeral on the member in FIG. 1, and a detailed description is omitted.

In the present modified embodiment, each of the unit cores 111A, 111B, and 112A to 112F has two projections for each, as shown in FIG. 6, and all of the projections of the unit cores 111A, 111B, and 112A to 112F are formed into an identical shape, and an interval between the projections facing each other composes a small gap, and an interval between end surfaces of the unit cores 111A, 111B, and 112A to 112F in a region part in which a projection positioned outside the projection is not disposed composes a large gap.

Further, the projections facing each other are coaxially formed, and therefore an area of the small gap simply corresponds to an area of the end surface of the projection. Further, an area of the large gap is obtained by subtracting an area of the end surface of the projection (the area of the small gap) from areas of end surfaces forming the projections of the unit coupling cores 112A to 112F.

In addition, the shape of each of the unit cores 111A, 111B, and 112A to 112F and the shape of each projection are not limited to the shapes of the embodiments. For example, as the shape of the unit core body, the body may be formed into a column shape in place of a rectangular parallelepiped shape, and as a shape of the projection, the projections corresponding to FIGS. 3B, 3C, 3D and 3E may be provided on both top and bottom surfaces of the unit core body in place of the projection corresponding to FIG. 3A.

As the unit coupling cores within one coil component, the unit coupling cores having the same shape may be used for all, or the unit coupling cores having a plurality of types of shapes may be used. Further, as base cores within one coil component, the base cores having the same shape to each other may be used or the base cores having shapes different from each other may be used.

The two-stage gap including the small gap and the large gap is configured to be formed as the gap in the reactors of the embodiment and the modified embodiment, but height levels of the projection is formed in two stages, and a three-stage gap including an end surface reference position may be configured to be prepared.

Further, a four-stage or more-stage gap may be configured to be formed by increasing the number of stages. Thus, a degree of freedom in the non-linear shape of the DC superposed characteristics to be formed can be improved.

In addition, the multiple-stage gap can be formed also by forming the projections provided each on the end surfaces facing each other relative to the adjacent two unit cores in such a manner that part thereof faces each other.

The gap is configured to be provided each in six places in the reactor of the embodiment and eight places in the reactor of the modified embodiment, but as the coil component of the present invention, the multiple-stage gap may be provided at least in one place within the closed magnetic path, and one-stage gap may be provided in other places within the closed magnetic path, or a shape may be formed in which no gap is provided.

A channel-shaped core or a U-shaped core may be used, in place of the I-type core composing the core part, or the core part is not composed of one core, but a plurality of cores may be combined and composed.

Further, each coupling core part is not limited to three unit cores, and may be composed of at least one unit core, and can be composed of a plurality of arbitrary pieces of unit cores.

In the reactors of the embodiment and the modified embodiment, the edgewise coil is used, but the reactor prepared by wounding any other type of coil, for example, a round coil may be used. Further, in the reactors of the embodiment and the modified embodiment no bobbin is shown, but a bobbin may be interposed between the core part 10, and the coils 14A, 14B to improve insulation.

Further, in the embodiment, the coil component is shown using an example of the reactor. However, as an application of the reactor, the present invention can be preferably applied to a vehicle mount device, but the present invention can be applied to an arbitrary reactor device in which the multiple-stage gap can be provided for part of the closed magnetic path to be formed by the core part, such as a reactor used in a photovoltaic power generation panel.

Further, the present invention can be applied not only to the reactor but also to other coil components as a whole, such as a choke coil.

What is claimed is:

1. A coil component comprising a coil and a core part composing a closed magnetic path through which a closed loop of a magnetic flux generated by the coil passes, wherein the coil component is configured in such a manner that the core part is formed of at least a plurality of unit cores, the plurality of unit cores are magnetically and sequentially coupled, and the closed magnetic path is formed as a whole, and a gap is formed by being provided between at least one set of adjacent unit cores, and a projection is provided on an end surface of at least one unit core of the at least one set of adjacent unit cores with interposing the gap therebetween, and the gap is formed of at least two types of gaps including at least a first gap and a second gap larger than the first gap, wherein the first gap is formed by a leading end surface region of the projection of a first unit core of a first set of adjacent unit cores and an end surface of a second unit core of the first set of adjacent unit cores facing the leading end surface region, and the second gap is formed by an end surface region in which the projection is not provided and an end surface facing the end surface region of the adjacent unit core.

2. The coil component according to claim 1, wherein the core part is formed into a square-shaped closed magnetic path by positioning two channel-shaped unit cores to face each other.

3. The coil component according to claim 1, wherein projections are provided on both end surfaces of the unit cores of each set of adjacent unit cores facing each other with the projections interposing the gaps therebetween, and the projections respectively formed on the end surfaces facing each other are arranged to be coaxial in a state in which the core part composes the closed magnetic path.

4. The coil component according to claim 1, wherein a projection is provided on an end surface of a first unit core of a first set of adjacent unit cores facing each other with the projection interposing the gap therebetween, and an end surface of a second unit core of the first set of adjacent unit cores is formed into a flat surface.

5. The coil component according to claim 1, wherein the inductance values in at least two DC value regions of a curve of the DC superposed characteristics can be controlled independently by the at least two types of gaps, and one of the at least two DC value regions serves as a region in which a DC current value becomes 0.

6. The coil component according to claim 1, wherein a spacer formed of an insulator is fitted into the gap.

7. The coil component according to claim 1, wherein the core part is further formed of two I-type base core parts respectively composing two sides facing each other, and two coupling core parts that couple the base cores and respectively compose two sides facing each other.

8. The coil component according to claim 7, wherein each of the coupling core parts is arranged within a coil through which a current passes, and each of the plurality of coupling core parts is formed by arranging a plurality of unit cores in a row.

9. The coil component according to claim 8, wherein a first unit core composing a first coupling core part is formed by providing, on a rectangular parallelepiped-shaped or column-shaped unit core body, a projection having a top surface analogous to a top surface of the unit core body.

10. The coil component according to claim 8, wherein a first unit core composing a first coupling core part is formed by providing, on a rectangular parallelepiped-shaped or column-shaped unit core body, one strip or two stripes strips of projections linearly extending between positions facing each other on a top surface of the body.

11. The coil component according to claim 8, wherein a first unit core composing a first coupling core part is formed by providing, on a rectangular parallelepiped-shaped or column-shaped unit core body, a two-stage projection.

* * * * *